US008292976B2

(12) United States Patent
Regrut et al.

(10) Patent No.: US 8,292,976 B2
(45) Date of Patent: Oct. 23, 2012

(54) DIESEL FUEL ADDITIVE FOR REDUCING EMISSIONS

(75) Inventors: Jon A. Regrut, Richmond, VA (US); Scott D. Schwab, Richmond, VA (US); Lawrence J. Cunningham, Mechanicsville, VA (US)

(73) Assignee: Afton Chemical Corporation, Richmond, VA (US)

( * ) Notice: Subject to any disclaimer, the term of this patent is extended or adjusted under 35 U.S.C. 154(b) by 351 days.

(21) Appl. No.: 12/613,596

(22) Filed: Nov. 6, 2009

(65) Prior Publication Data

US 2011/0107658 A1 May 12, 2011

(51) Int. Cl.
*C10L 1/23* (2006.01)

(52) U.S. Cl. ..... 44/324

(58) Field of Classification Search ..... 44/324
See application file for complete search history.

(56) References Cited

U.S. PATENT DOCUMENTS

| | | | | |
|---|---|---|---|---|
| 4,060,569 | A | 11/1977 | Woods et al. | |
| 4,239,546 | A | 12/1980 | Russell et al. | |
| 4,943,672 | A | 7/1990 | Hamner et al. | |
| 5,882,505 | A | 3/1999 | Wittenbrink et al. | |
| 6,013,171 | A | 1/2000 | Cook et al. | |
| 6,080,301 | A | 6/2000 | Berlowitz et al. | |
| 6,096,940 | A | 8/2000 | Wittenbrink et al. | |
| 6,103,099 | A | 8/2000 | Wittenbrink et al. | |
| 6,165,949 | A | 12/2000 | Berlowitz et al. | |
| 6,180,575 | B1 | 1/2001 | Nipe | |
| 6,776,808 | B2 | 8/2004 | Foster | |
| 2004/0060229 | A1 | 4/2004 | Todd et al. | |
| 2006/0112614 | A1 | 6/2006 | Davenport et al. | |
| 2008/0196586 | A1 * | 8/2008 | Karl et al. | 95/154 |
| 2008/0295395 | A1 | 12/2008 | Harrell et al. | |
| 2009/0209793 | A1 | 8/2009 | Selby et al. | |

FOREIGN PATENT DOCUMENTS

EP 457589 * 11/1991

* cited by examiner

*Primary Examiner* — Cephia D Toomer

(74) *Attorney, Agent, or Firm* — Luedeka Neely Group, P.C.

(57) ABSTRACT

A fuel additive and method for reducing emissions from an engine combusting a middle distillate fuel. The fuel additive contains a synergistic combination of (a) a cetane improver and (b) a mineral oil co-additive.

18 Claims, No Drawings

DIESEL FUEL ADDITIVE FOR REDUCING EMISSIONS

TECHNICAL FIELD

The disclosure is directed to fuel additives, in particular to diesel fuel additives that provide a benefit with respect to emissions of undesirable components from the combustion of the fuel.

BACKGROUND AND SUMMARY

Considerable effort and multiple schemes have been devised in an attempt to reduce exhaust emissions from compression ignition (e.g. internal combustion) engines operating on middle distillate fuels. Exhaust emissions are produced by burning fuel in the engine and are emitted through an exhaust system from the engine. A majority of the emissions include hydrocarbons, which are unburned or partially burned fuels, nitrogen oxides ($NO_X$) which are generated when nitrogen in the air reacts with oxygen under the high temperature and pressure conditions inside the engine, carbon monoxide (CO) which is a product of incomplete combustion, particulates, and carbon dioxide ($CO_2$) which is a product of the complete combustion of hydrocarbons.

In an attempt to reduce emissions, components may be added to the fuel that may be effective for reducing one or more of hydrocarbons, $NO_X$, CO, and particulates. However, diesel fuels present a particularly difficult emissions problem because of the need to simultaneously reduce both particulate and $NO_X$ emissions. For example, additives which lower particulate emissions may increase $NO_X$ emissions, and vice versa. Accordingly, it would be desirable to provide additives for diesel fuels that are effective for lowering $NO_X$ emissions without adversely affecting the amount of particulate emissions emitted from the engine.

With regard to the foregoing, embodiments of the disclosure provide a fuel additive and method for reducing emissions from an engine combusting a middle distillate fuel. The fuel additive contains a synergistic combination of (a) a cetane improver and (b) a mineral oil co-additive.

In an exemplary embodiment, the disclosure provides a method for reducing $NO_X$ emissions from an engine exhaust for an engine combusting a middle distillate fuel. The method includes the steps of incorporating in a middle distillate fuel an amount of a synergistic combination of (a) an alkyl nitrate ester and (b) a mineral oil co-additive.

Another exemplary embodiment of the disclosure provides an additive package for a middle distillate fuel. The additive package includes (a) an alkyl nitrate ester and (b) a mineral oil co-additive. A volume ratio of (a) to (b) in the additive package ranges from about 1:1 to about 30:1.

An advantage of the disclosed embodiments is that the additive package described herein may exhibit an unexpected synergistic decrease in $NO_X$ emissions from the combusting of a middle distillate fuel, compared to other additives and additive combinations. Furthermore, the additive package may not exhibit an adverse increase in particulate emissions compared to other additives used to improve $NO_X$ emissions. Other benefits and advantages may be apparent from the following detailed description and examples.

DETAILED DESCRIPTION OF EXEMPLARY EMBODIMENTS

In accordance with exemplary embodiments of the disclosure, the additives and methods described herein may be effective for reducing the amount of exhaust emissions resulting from the combustion of hydrocarbon fuels in compression ignition engines such as internal combustion engines. In particular, exemplary embodiments of the disclosure related to fuel additives and additive packages for fuels which may synergistically reduce $NO_X$ emissions and/or particulate matter in the exhaust from an engine combusting the fuel.

The fuel additive and additive package described herein includes a combination of (a) a cetane improver and (b) a mineral oil co-additive. A middle distillate fuel may be formulated with the fuel additive or the additive package may be added to a fully formulated fuel composition.

Component (a) of the fuel additive or additive package may be selected from commercially available certain cetane improvers. Such cetane improvers include, but are not limited to, nitrate-containing cetane improvers and peroxide cetane improvers. Examples of nitrate-containing cetane improvers that may be used include methyl nitrate, ethyl nitrate, propyl nitrate, isopropyl nitrate, allyl nitrate, butyl nitrate, isobutyl nitrate, sec-butyl nitrate, tert-butyl nitrate, amyl nitrate, isoamyl nitrate, 2-amyl nitrate, 3-amyl nitrate, n-pentyl nitrate, hexyl nitrate, heptyl nitrate, 2-heptyl nitrate, octyl nitrate, isooctyl nitrate, 2-ethylhexyl nitrate, nonyl nitrate, decyl nitrate, undecyl nitrate, dodecyl nitrate, cyclopentyl nitrate, cyclohexyl nitrate, methylcyclohexyl nitrate, cyclododecyl nitrate, 2-ethoxyethyl nitrate, 2-(2-ethoxyethoxy)ethyl nitrate, tetrahydrofuranyl nitrate, tetraethyleneglycol dinitrate, isomers thereof, and mixtures thereof. A suitable nitrate-containing cetane improver in an embodiment of the disclosure that may be used is 2-ethyl hexyl nitrate ("2-EH nitrate").

Other cetane improvers that may be used include peroxide/hydroperoxide cetane improvers such as di-tert-butyl peroxide. As used herein, the term "peroxides" is meant to include peroxides, hydroperoxides, mixtures thereof and precursors thereof.

The second component of the additive package is a mineral oil component. The mineral oil component may be selected from any of the relatively low sulfur mineral base oils in Groups II-III as specified in the American Petroleum Institute (API) Base Oil Interchangeability Guidelines. The term "low sulphur" in terms of the embodiments of this disclosure means that the mineral oil contains no more than about 150 ppm by weight sulfur, for example, no more than about 100 ppm by weight sulfur, and more particularly, less than about 50 ppm by weight sulfur.

The mineral oil component may be an oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. For example, the hydrocarbons may be hydroisomerized using processes disclosed in U.S. Pat. No. 6,103,099 or 6,180,575; hydrocracked and hydroisomerized using processes disclosed in U.S. Pat. No. 4,943,672 or 6,096,940; dewaxed using processes disclosed in U.S. Pat. No. 5,882,505; or hydroisomerized and dewaxed using processes disclosed in U.S. Pat. No. 6,013,171; 6,080,301; or 6,165,949.

Refined, and rerefined mineral oils, as well as mixtures of two or more of any of these) of the type disclosed hereinabove may be used in the mineral oil component. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

The combination of cetane improver and mineral oil component may function to primarily lower the $NO_X$ emissions although reduction in particulates may also be expected. Alternatively, $NO_X$ emissions may be lowered by the compositions described herein without appreciably raising particulate emissions, which would also be an advantage and an improvement over available fuel additives.

In one non-limiting embodiment, a composition for improving the emissions of distillate fuels may be a mixture or blend of cetane improver and a low sulfur mineral oil. The combination of components may be present in a middle distillate fuel in the range of about 500 to about 5000 ppm by volume, in one non limiting embodiment from about 1000 up to about 2500 ppm by volume based on a total volume of fuel. The cetane improver may be present in the fuel in an amount ranging from about 250 to about 5000 ppm by volume and the mineral oil component may be present in the fuel in an amount ranging from about 50 to about 500 ppm by volume based on a total volume of the additive in the fuel. Hence a volume ratio of the cetane improver to the mineral oil component in the additive and fuel may range from about 1:1 to about 30:1. For example, a volume ratio of cetane improver to mineral oil may be selected from 1:1, 2:1, 3:1, 4:1, 5:1, 6:1, 7:1, 8:1, 9:1, 10:1, 11:1, 12:1, 13:1, 14:1, 15:1, 16:1, 17:1, 18:1, 19:1, 20:1, 21:1, 22:1, 23:1, 24:1, 25:1, 26:1, 27:1, 28:1, 29:1, and 30:1 A particularly useful volume ratio of cetane improver to mineral oil component may range from about 10:1 to about 20:1.

In accordance with the disclosure, the additives and methods described herein may be used for reducing emissions from the combustion of middle distillate fuels, including but not limited to, diesel fuel, kerosene, fuel oil, biodiesel and the like. It will be appreciated that distillate fuels include blends of conventional hydrocarbons meant by these terms with biodiesel blending components presently used in these distillate fuels, or that may be used in the future. In one non-limiting embodiment herein, distillate fuels include low sulfur fuels, which are defined as having a sulfur content of 0.01% by weight or less, and in another non-limiting embodiment as having a sulfur content of about 0.0015 wt. % or less-such as the so-called "ultra low sulfur" fuels. Particularly suitable hydrocarbon fuels according to the disclosure are diesel and kerosene. It is expected that a more conventional diesel fuel (i.e. with an aromatic content of greater than or equal to 25 wt. %) treated with the additive composition herein will be equivalent in emissions to a Texas Low Emissions Diesel (TxLED) fuel with <10% aromatic content.

Bio-diesel fuels are typically fatty acid ethyl or methyl esters derived animal fats and from edible or non-edible vegetable oils such as, but not limited to, canola, sunflower, rapeseed, soyabean, linseed, and palm oils using transesterification. Biodiesel is a non-fossil fuel alternative that may be mixed with a petroleum derived diesel in any amount in modern engines. A small percentage of biodiesel may be used as an additive in low-sulphur formulations of conventional diesel fuels to increase the lubricity lost when the sulphur is removed. Chemically, biodiesels typically consist of alkyl, such as methyl or ethyl, esters instead of the alkanes and aromatic hydrocarbons of petroleum based diesel fuels. However, biodiesel has combustion properties very similar to petroleum diesel fuels, including combustion energy and cetane ratings.

Synthetic diesel fuels may be produced from wood, hemp, straw, corn, garbage, food scraps and sewage-sludge being dried and gasified to synthesis gas. After purification the Fischer-Tropsch process may be used to produce synthetic diesel. Such processes are often called biomass-to-liquid or BTL. Synthetic diesel may also be produced from natural gas in a gas-to-liquid (GTL) process or from coal in a coal-to-liquid (CTL) process.

It will be appreciated that the embodiments described herein may also include distillate fuels containing the additive combination for lowering $NO_X$ emissions, as well as methods of improving the emissions properties of distillate fuels using the additive compositions described herein.

The distillate fuels described herein may include other optional components. Such optional components include, but are not limited to, detergents, pour point depressants, additional cetane improvers, lubricity additives, dehazers, cold operability additives, conductivity additives, biocides, dyes, and mixtures thereof. In another non-limiting embodiment, the additive compositions described herein may be substantially devoid of water.

In order to illustrate specific features of the disclosed embodiments, the following non-limiting examples are provided. The following examples are not intended to limit the invention, but merely serve as an illustrative example thereof.

EXAMPLE

Data for $NO_X$ and particulate emissions from the combustion of middle distillate fuel in an engine was obtained by using a Detroit Diesel Corporation in-line 6 cylinder, turbo charged and intercooled 11.1 L engine Model number 6067WK60 that was factory rebuilt to meet 1993 to 1995 specifications and EPA certification number 1332. The engine had 330 horsepower at 1800 rpm, developed 1229 ft-lb torque at 1300 rpm and was mounted in a transient-capable test cell. The engine used a laboratory water to air heat exchanger for a charge air intercooler. The exhaust was routed to a full flow constant volume sampler that used a positive displacement pump. Total flow in the exhaust conduit was maintained at a nominal flow rate of about 2000 SCFM. Sample zone probes for particulate matter (PM), heated oxides of nitrogen ($NO_X$), heated hydrocarbons (HC), carbon monoxide (CO), and carbon dioxide ($CO_2$) measurements were connected to the main exhaust conduit. Probes for background gas measurement were connected downstream of the dilution air filter pack, but upstream of a mixing section. The dilution system was equipped with pressure and temperature sensors at various locations in order to obtain all necessary information required by the U.S. Code of Federal Regulation (40 CFR, Part 86, Subpart N).

Test data for the base fuel and the fuel containing additive components (a) and (b) and the additive combination are shown in the following table. Component (a), 2-EHN, was present in an amount of 2000 ppm by volume of the total volume of fuel and component (b), a mineral oil (YUBASE 8), was present in an amount of 200 ppm by volume of the total volume of fuel. YUBASE 8 is a group III mineral oil obtained from SK Energy with a kinematic viscosity of 8 cSt.

TABLE

| | $NO_X$ Emissions (g/hp-hr) | % Reduction in $NO_X$ Emissions | Particulate Emissions (g/hp-hr) | % Reduction in Particulates |
|---|---|---|---|---|
| Base Fuel | 4.870 | — | 0.0709 | — |
| Base Fuel plus component (a) | 4.831 | 0.80 | 0.063 | 11.18 |
| Base Fuel plus component (b) | 4.824 | 0.94 | 0.063 | 11.18 |
| Base Fuel plus components (a) and (b) | 4.718 | 3.12 | 0.063 | 11.18 |

As shown by the foregoing table, both component (a) and component (b) lowered $NO_X$ emissions without adversely affecting particulate emissions. However, it was expected that the combination of (a) and (b) would have lowered $NO_X$ emissions by the sum of the effects of the individual components. However, as shown in the above table, the combination of components (a) and (b) in a fuel provided a synergistic increase in the reduction of $NO_X$ emissions (3.12%) that was 80% greater than the $NO_X$ emissions expected from the sum (1.74%) of the $NO_X$ emissions of the individual components (a) and (b) added to the fuel. This result was surprising and totally unexpected. Furthermore, the components (a) and (b) either alone or in combination did not adversely affect the reduction in particulate emissions from the fuel but did provide such a reduction in particulate emissions.

Compositions described as "comprising" a plurality of defined components are to be construed as including compositions formed by admixing the defined plurality of defined components. The principles, preferred embodiments and modes of operation of the present disclosure have been described in the foregoing specification. What applicants submit, however, is not to be construed as limited to the particular embodiments disclosed, since the disclosed embodiments are regarded as illustrative rather than limiting. Changes may be made by those skilled in the art without departing from the spirit of the disclosed embodiments.

What is claimed is:

1. A fuel additive for a middle distillate fuel, consisting essentially of a synergistic combination of (a) from about 250 to about 5000 ppm by volume based on a total volume of fuel of a cetane improver and (b) a low-sulfur Group II or Group III mineral oil co-additive, wherein a volume ratio of (a) to (b) in the additive ranges from about 4:1 to about 20:1, and wherein the additive provides a synergistic decrease in $NO_x$ emissions.

2. The fuel additive of claim 1, wherein the cetane improver comprises an alkyl nitrate ester selected from the group consisting of 2-ethylhexyl nitrate, iso-octyl nitrate, iso-propyl nitrate, iso-amylnitrate, iso-hexylnitrate, cyclohexyl nitrate, dodecyl nitrate, diglycol nitrate, tetraglycol nitrate, and combinations thereof.

3. The fuel additive of claim 1, wherein the mineral oil comprises a hydrocracked or hydrotreated mineral oil.

4. A middle distillate fuel comprising the fuel additive of claim 1.

5. The fuel of claim 4, wherein the fuel additive is present in the fuel in an amount ranging from about 500 to about 5000 ppm by volume based on a total volume of the fuel.

6. The fuel of claim 5, wherein the middle distillate fuel is selected from the group consisting of diesel fuel, fuel oil, biofuels, and a combination thereof.

7. A method for synergistically reducing $NO_x$ emissions from an engine exhaust for an engine combusting a middle distillate fuel, comprising:

incorporating in a middle distillate fuel an amount of a synergistic combination of (a) from about 250 to about 5000 ppm by volume based on a total volume of fuel of an alkyl nitrate ester and (b) a low-sulfur Group II or Group III mineral oil co-additive, wherein a volume ratio of (a) to (b) in the synergistic combination ranges from about 4:1 to about 20:1; and combusting the fuel in the engine, whereby there is at least about 80% greater reduction in $NO_X$ emissions emission reductions from components (a) or (b) alone.

8. The method of claim 7, wherein the alkyl nitrate ester is selected from the group consisting of 2-ethylhexyl nitrate, iso-octyl nitrate, iso-propyl nitrate, iso-amylnitrate, iso-hexylnitrate, cyclohexyl nitrate, dodecyl nitrate, diglycol nitrate, tetraglycol nitrate, and combinations thereof.

9. The method of claim 7, wherein the mineral oil comprises a hydrocracked or hydrotreated mineral oil.

10. The method of claim 7, wherein the amount of synergistic combination in the fuel ranges from about 500 to about 5000 ppm by volume based on a total volume of the fuel.

11. The method of claim 7, wherein the middle distillate fuel is selected from the group consisting of diesel fuel, fuel oil, biofuels, and a combination thereof.

12. An additive package for a middle distillate fuel for synergistically reducing $NO_x$ emissions consisting essentially of (a) from about 250 to about 5000 ppm by volume based on a total volume of fuel of an alkyl nitrate ester and (b) a low-sulfur mineral oil co-additive, wherein a volume ratio of (a) to (b) in the additive package ranges from about 4:1 to about 20:1.

13. The additive package of claim 12, wherein the alkyl nitrate ester iso-propyl nitrate, iso-amylnitrate, iso-hexylnitrate, cyclohexyl nitrate, dodecyl nitrate, diglycol nitrate, tetraglycol nitrate, and combinations thereof.

14. The additive package of claim 12, the mineral oil comprises a Group II or Group III hydrocracked or hydrotreated mineral oil.

15. A middle distillate fuel comprising the additive package of claim 12.

16. The fuel of claim 15, wherein the additive package is present in the fuel in an amount ranging from about 500 to about 5000 ppm by volume based on a total volume of the fuel.

17. The fuel of claim 15, wherein the middle distillate fuel is selected from the group consisting of diesel fuel, fuel oil, and a combination thereof.

18. The additive package of claim 12 wherein the volume ratio of (a) to (b) in the additive package ranges from about 10:1 to about 20:1.

* * * * *